US007345526B2

(12) United States Patent
Chen et al.

(10) Patent No.: US 7,345,526 B2
(45) Date of Patent: Mar. 18, 2008

(54) LINEAR-IN-DECIBEL CURRENT GENERATORS

(75) Inventors: Shin-Fu Chen, Tainan (TW); Po-Sen Tseng, Hsinchu Hsien (TW)

(73) Assignee: Mediatek Inc., Hsin-Chu (TW)

( * ) Notice: Subject to any disclaimer, the term of this patent is extended or adjusted under 35 U.S.C. 154(b) by 44 days.

(21) Appl. No.: 11/464,841

(22) Filed: Aug. 16, 2006

(65) Prior Publication Data

US 2008/0042740 A1 Feb. 21, 2008

(51) Int. Cl.
*G05F 1/10* (2006.01)

(52) U.S. Cl. ..... 327/538

(58) Field of Classification Search ..... 327/530, 327/534, 535, 537, 538, 540, 541, 543
See application file for complete search history.

(56) References Cited

U.S. PATENT DOCUMENTS 5,572,166 A 11/1996 Gilbert 6,958,656 B2 * 10/2005 Yamashita et al. ..... 330/285

OTHER PUBLICATIONS

Lecture script from "Advanced Integrated Circuits for Communications", Meyer, Jan. 30, 2004.

* cited by examiner

*Primary Examiner*—Jeffrey Zweizig
(74) *Attorney, Agent, or Firm*—Thomas, Kayden, Horstemeyer & Risley

(57) ABSTRACT

Linear-in-dB current generators having a maximum gain with least gain error. A first transistor is coupled between a first node and a first power voltage, and a first resistor is coupled between the first transistor and a second node. A second transistor is coupled between the second node and a second power voltage and comprises a control terminal coupled to the first node, and a third transistor comprises a first terminal coupled to the second power voltage, and a control terminal coupled to the first node. A second resistor is coupled between the third transistor and a third node, and a fourth transistor comprises a first terminal coupled to the first terminal, and a control terminal coupled to the third node. A first current source and the second current source are coupled to the second node and the third node respectively, and a reference current source is coupled to the first node.

19 Claims, 6 Drawing Sheets

LINEAR-IN-DECIBEL CURRENT GENERATORS

BACKGROUND OF THE INVENTION

1. Field of the Invention

The invention relates to current generators, and in particular to linear-in-dB current generators having a maximum gain with least gain error and variable gain amplifiers using the same.

2. Description of the Related Art

In communications systems, analog receivers vary the amount of gain according to the specific receiver operation and the strength of the received signal, to maintain a constant signal level. Variable-gain amplifiers are typically used to achieve this desired effect in the receiver. Because of the wide range of received signal strength, the variable gain amplifier must be able to vary its gain over a wide range. Linear-in-decibel variable gain amplifiers have become known to provide this desired level of gain control.

The problem with conventional linear-in-decibel variable gain amplifiers is that they are complex and suffer from accuracy and bandwidth limitations. Accordingly, a need remains for a simple yet accurate variable amplifier, linear in decibels.

BRIEF SUMMARY OF THE INVENTION

A detailed description is given in the following embodiments with reference to the accompanying drawings.

Embodiments of linear-in-dB current generators are provided, in which a first transistor is coupled between a first node and a first power voltage and comprises a control terminal, and a first resistor is coupled between the control terminal of the first transistor and a second node. A second transistor is coupled between the second node and a second power voltage and comprises a control terminal coupled to the first node, and a first current source is coupled between the second node and the first power voltage. A third transistor comprises a first terminal coupled to the second power voltage, a control terminal coupled to the first node, and a second terminal. A second resistor is coupled between the second terminal of the third transistor and a third node, and a fourth transistor comprises a first terminal coupled to the first terminal, a control terminal coupled to the third node, and a second terminal outputting an output current. A second current source is coupled between the first power voltage and the third node, and a reference current source is coupled between the second power voltage and the first node.

The invention also provides embodiments of linear-in-dB current generators, in which a first transistor is coupled between a first node and a second power voltage and comprises a control terminal, and a first resistor is coupled between the control terminal of the first transistor and a second node. A second transistor is coupled between the second node and a second power voltage and comprises a control terminal coupled to the first node, and a third transistor comprises a first terminal coupled to the second power voltage, a control terminal coupled to the first node, and a second terminal. A second resistor is coupled between the second terminal of the third transistor and a third node, and a fourth transistor comprises a first terminal coupled to the first terminal, a control terminal coupled to the third node, and a second terminal outputting an output current. A first reference current source is coupled between the second power voltage and the first node, and a second reference current is coupled between the second power voltage and a fourth node. A fifth transistor is coupled between the second power voltage and a fifth node and comprises a control terminal coupled to the fourth node, and a sixth transistor is coupled between the first power voltage and the fourth node and comprises a control terminal coupled to the fifth node. A seventh transistor comprises a first terminal coupled to the first power voltage, a control terminal coupled to the fifth node and a second terminal, and a third resistor is coupled between the second node and the second terminal of the seventh transistor, and an eighth transistor is coupled between the third node and the first power voltage and comprises a control terminal coupled to the fifth node.

The invention also provides embodiments of variable gain amplifiers, in which the disclosed linear-in-dB current generator provides the output current as a bias current, and an amplifier unit coupled to the current generator comprises a gain proportional to the bias current.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
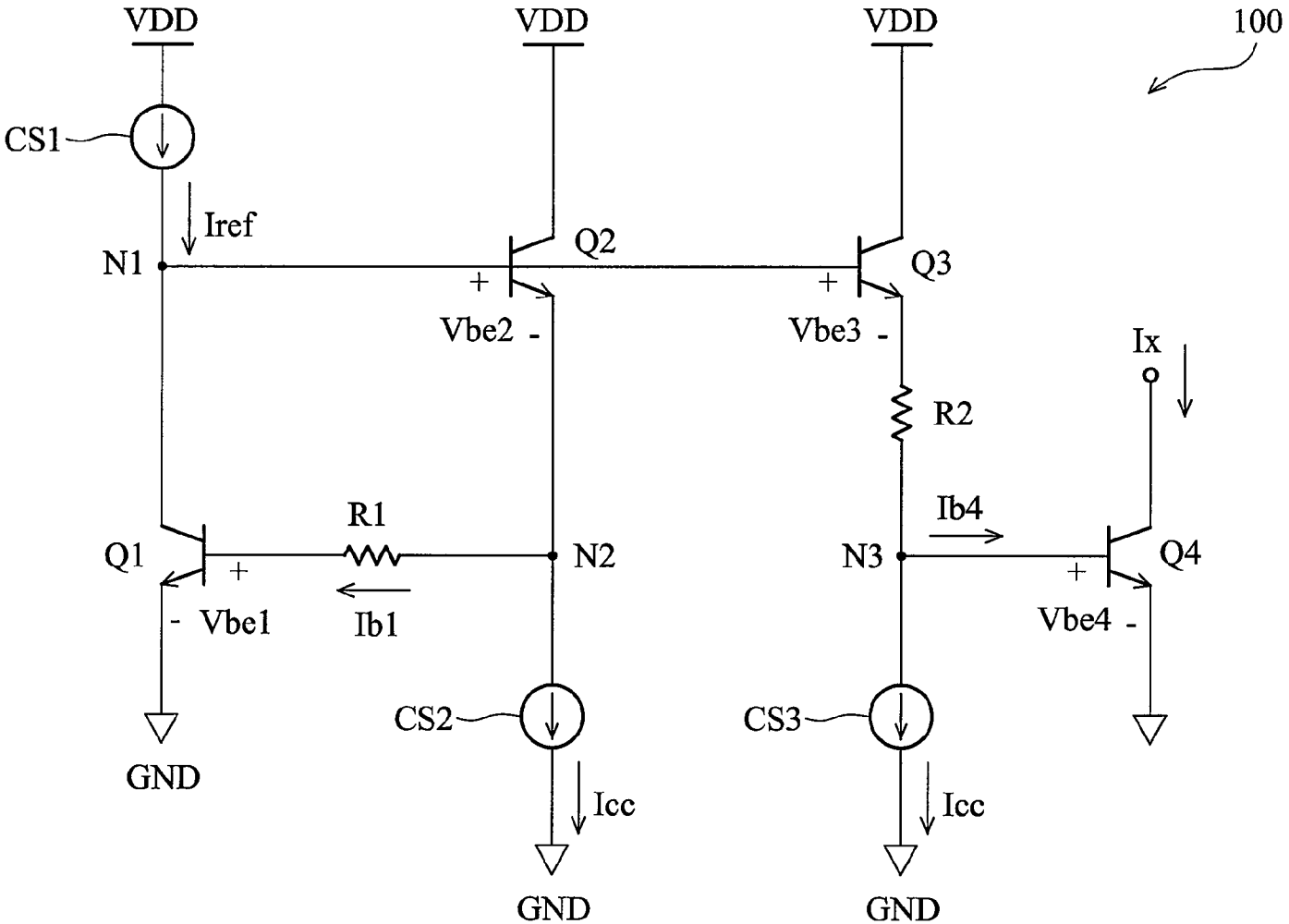
FIG. 1 is a diagram of a linear-in-dB current generator of the invention.

FIG. 1 is a diagram of a linear-in-dB current generator of the invention. As shown, a linear-in-dB current generator 100 comprises transistors Q1~Q4, resistors R1 and R2, current sources CS1, CS2 and CS3, and has a maximum gain with least gain error.

The current source CS1 is coupled between power voltage VDD and a node N1 to provide a reference current (input current) Iref, the transistor Q1 comprises a collector coupled to the node N1, an emitter coupled to power voltage GND, and a base. The resistor R1 is coupled between the base of the transistor Q1 and a node N2, the transistor Q2 comprises a collector coupled to the power voltage VDD, a base coupled to the node N1, and an emitter coupled to the node N2. The current source CS2 is coupled between the node N2 and the power voltage GND to provide a current Icc, the transistor Q3 comprises a collector coupled to the power voltage VDD, a base coupled to the node N1, and an emitter. The resistor R2 is coupled between the emitter of the transistor Q3 and a node N3, the current source CS3 is coupled between the node N3 and the power voltage GND to provide a current Icc. The transistor Q4 comprises a base coupled to the node N3, an emitter coupled to the power voltage GND, and collector outputting an output current Ix.

In the embodiment, the resistor R1 is identical to the resistor R2, the transistor Q2 is identical to the transistor Q3 and the current source CS1 is identical to the current source CS2 providing the current Icc, preferably.

Figure 2A:
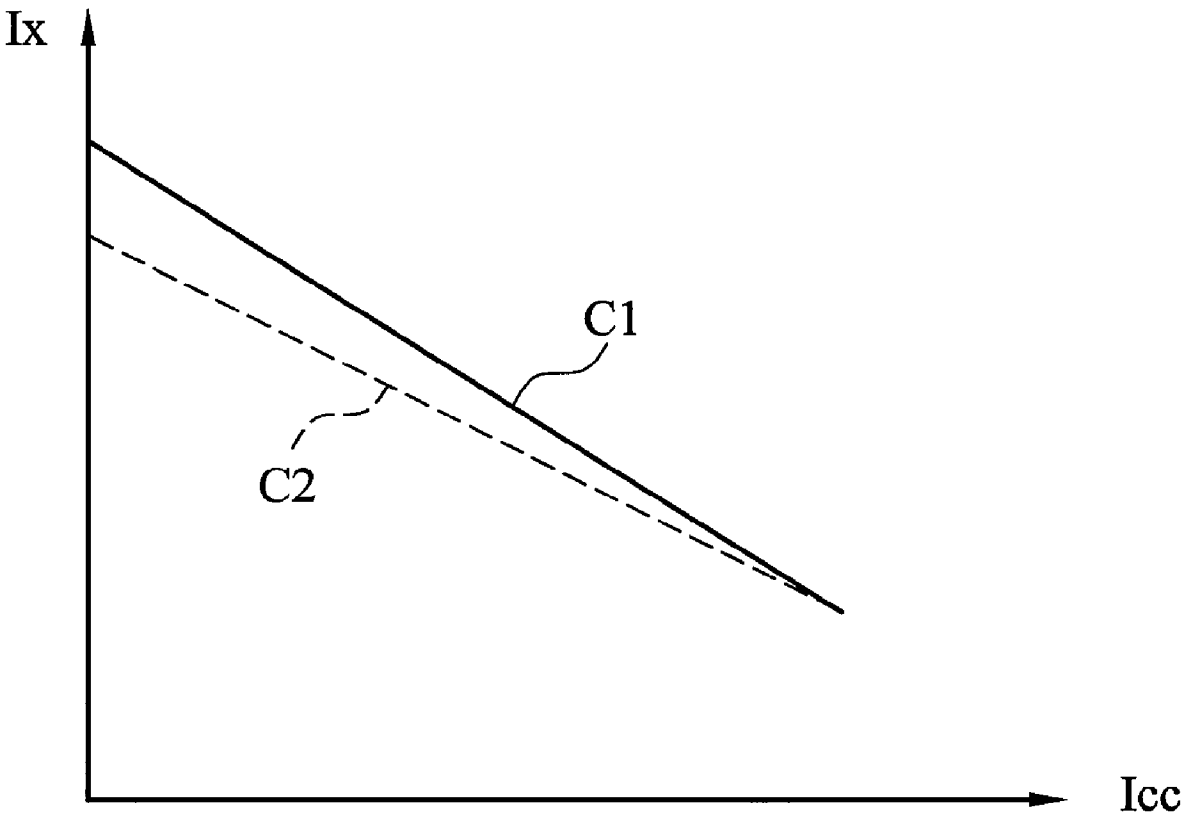
FIG. 2A shows a relationship between the output current and control current of the current generator without the resistor R1 of the invention.

As the resistor R1 coupled between the node N2 and the base of the transistor Q1 is omitted, the output current Ix can be expressed as:

$$I_x = Iref \times \exp\left(\frac{-(Icc + Ib4) \times R2}{V_T}\right),$$

in which the Icc is the current provided by the current sources CS2 and CS3, Ib4 is the current through the base of the transistor Q4, $V_T$ is thermal voltage and Iref is the current provided by the current source CS1. The relationship between the currents Ix and Icc is shown in FIG. 2A. As shown, the curve C1 shows the relationship between the currents Ix and Icc without base current effect, and the curve C2 shows the relationship between the currents Ix and Icc with base current effect. The current Ix presents maximum error due to base current of the transistor Q4 when the current source Icc=0. Namely, in the linear-in-dB current generator, when the current Icc is minimum, the current $I_x$ is maximum, with level thereof affected by the base current $I_{b4}$ of the transistor Q4. Thus, the linear-in-dB current generator provides a maximum gain with maximum gain error.

In order to overcome this problem, the invention utilizes the resistor R1 between the base of the transistor Q1 and the node N2, such that the linear-in-dB current generator of the invention obtains a maximum gain with least gain error.

Operation and principle of the linear-in-dB current generator 100 are described hereinafter, in which the base current of the transistor Q2 and the transistor Q3 is assumed to be compensated.

Based on Kirchhoff's voltage law (KVL), a loop formula (1) can be expressed as: $V_{be1}+I_{b1}\times R1+V_{be2}=V_{be3}+(I_{cc}+I_{b4})\times R2+V_{be4}$.

As the emitter-base voltage $V_{be}$ of a forward active operation BJT transistor can be expressed as $$V_T \ln\frac{Ic}{Is}$$

in which $V_T$ is thermal voltage, $I_C$ is the collector current, and $I_S$ is the saturation current. The loop formula (1) can be expressed as:

$$V_T \ln\frac{Iref}{Is} + I_{b1} \times R1 + V_T \ln\frac{I_{cc}}{Is} = V_T \ln\frac{I_{cc}}{Is} + (I_{cc} + I_{b4}) \times R2 + V_T \ln\frac{I_x}{Is} \quad (2)$$

Because R1=R2, the current source CS2 is identical to the current source CS3 and the transistor Q2 is identical to the transistor Q3, the formula (2) can be expressed as:

$$\ln\frac{I_x}{Iref} = \frac{-(I_{cc} + I_{b4} - I_{b1}) \times R2}{V_T}$$

$$I_x = Iref \times \exp\left(\frac{-(Icc + Ib4 - Ib1) \times R2}{V_T}\right) \quad (3)$$

Figure 2B:
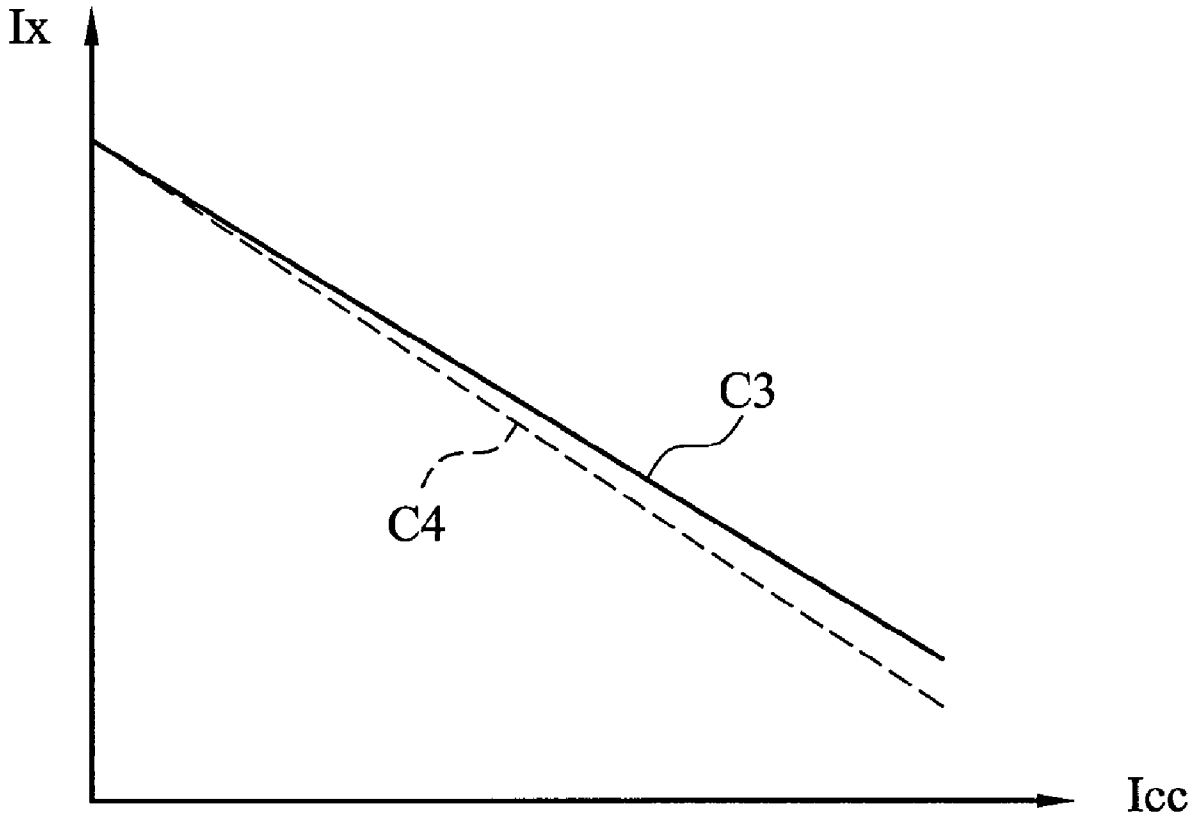
FIG. 2B shows a relationship between the output current and control current of the current generator of the invention.

The relationship between the currents Ix and Icc in the linear-in-dB current generator 100 is shown in FIG. 2B, in which the curve C3 shows the relationship between the currents Ix and Icc without base current effect, and the curve C4 shows the relationship between the currents Ix and Icc with base current effect. Because the base current Ib4 of the transistor Q4 can be compensated by the base current Ib1 of the transistor Q1, the current Ix is equivalent to the current Icc nearly when the current Icc≅0. Namely, in the linear-in-dB current generator 100, when the current Icc is minimum, the current Ix is maximum and not affected by the base current $I_{b4}$ of the transistor Q4. Thus, linear-in-dB current generator 100 has a maximum gain with least gain error. Further, as shown in formula (3), the relationship between the control current and the resulting gain in the current generator 100 is referred to herein as "linear-in-dB" because an exponential gain function is linear on a log scale.

Figure 3:
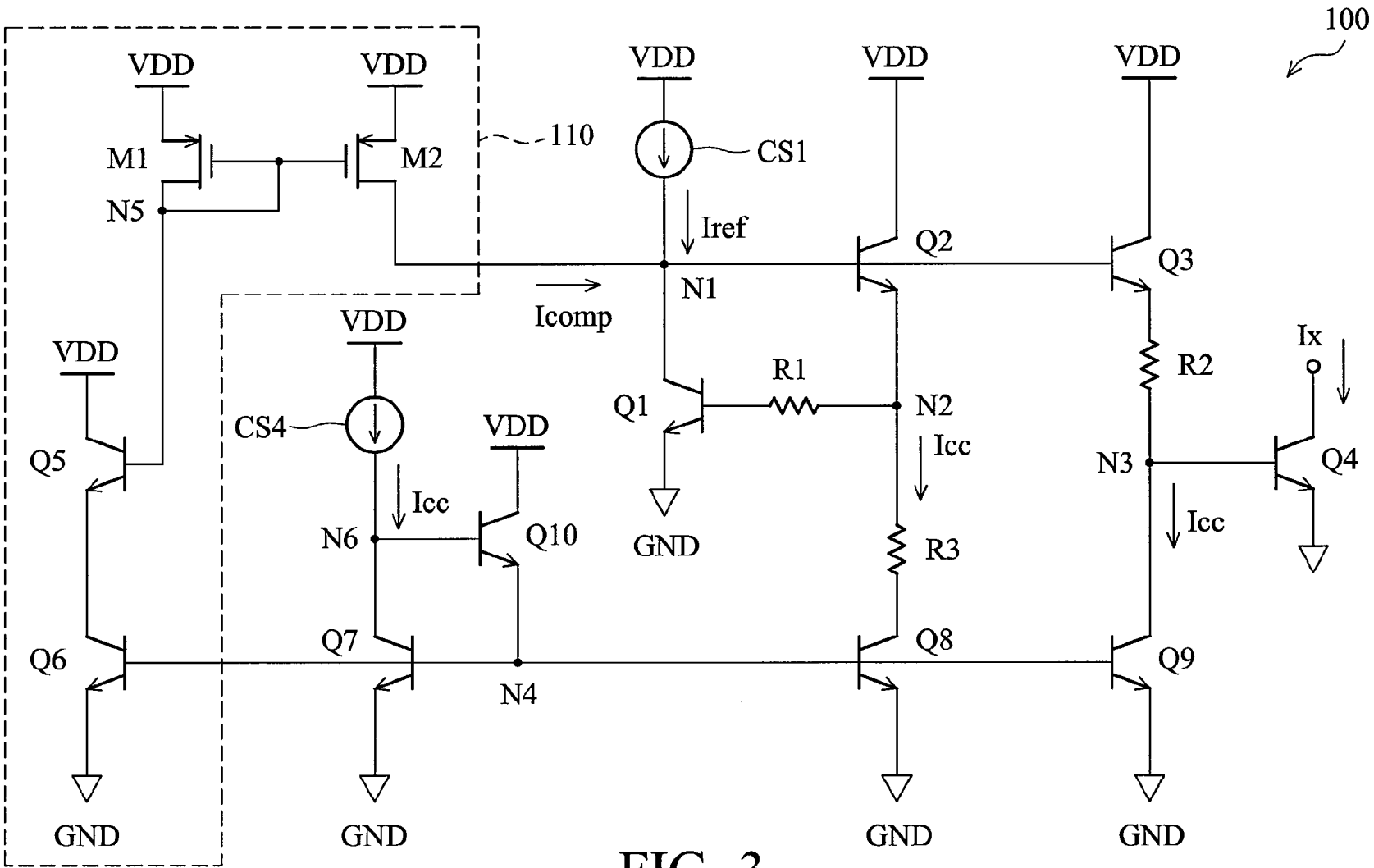
FIG. 3 shows an embodiment of a linear-in-dB current generator of the invention.

FIG. 3 shows an embodiment of the linear-in-dB current generator 100. Description of the same elements and structure shown in FIG. 1 are omitted for simplification. As shown, the linear-in-dB current generator 100 further comprises a base current compensation circuit 110 to compensate base currents of the transistor Q2 and the transistor Q3, and the current sources CS2 and CS3 are implemented by a reference current source CS4, transistors Q7~Q10 and a resistor R3. In the embodiment, the resistor R3 is identical to the resistors R1 and R2, and the transistors Q5~Q9 are identical preferably.

The reference current source CS4 is coupled between the power voltage VDD and the base of the transistor Q10, the transistor Q7 comprises a collector coupled to the reference current source CS4, a base coupled to a node N4, an emitter coupled to the power voltage GND. The transistor Q8 comprises an emitter coupled to the power voltage GND, a base coupled to the node N4, and a collector coupled to the resistor R3, and the transistor Q9 comprises an emitter coupled to the power voltage GND, a base coupled to the node N4, and a collector coupled to the node N3. The transistor Q10 comprises a collector coupled to the power voltage VDD, an emitter coupled to the node N4 and a base coupled to the reference current source CS4 through a node N6 and the collector of the transistor Q7. The transistors Q7~Q10 form a current mirror, such that the current Icc provided by the reference current source CS4 is mirrored and output by the transistors Q8 and Q9. The resistor R3, identical to the resistors R1 and R2, is disposed between the node N2 and the collector of the transistor Q8 to maintain matching of the headroom of the transistors Q8 and Q9.

The base current compensation unit 110 comprises bipolar transistors Q5 and Q6 and MOS transistors M1 and M2. The transistor Q6 comprises an emitter coupled to the power voltage GND, a base coupled to the node N4, a collector coupled to the transistor Q5, and the transistor Q5 comprises an emitter coupled to the collector of the transistor Q6, a collector coupled to the power voltage VDD, and a base coupled to a nose N5. The transistor M1 comprises a first terminal coupled to the power voltage VDD and a second terminal coupled to the node N5, and a control terminal coupled to the node N5, and the transistor M2 comprises a first coupled to the power voltage VDD, a control terminal coupled to the node N5 and a second terminal coupled to the node N1.

Because the transistors Q2~Q3 and Q5~Q9 are identical, current through the transistor Q2~Q3, Q7~Q9 and Q6 are equivalent to Icc, and thus, the base currents of the transistors Q2~Q3 and Q5~Q9 can be the same. As the transistors M1 and M2 are connected in a current mirror and the size of the transistor M2 is twice that of the transistor M1, such that the transistor M2 can generate a compensation current Icomp equivalent to twice the base current of the transistor Q2/Q3. Hence, the base currents of the transistors Q2 and Q3 can be compensated by the compensation current Icomp from the base current compensation unit 110, reducing base current effect in the linear-in-dB current generator 100. As represented by the formula $$I_x = Iref \times \exp\left(\frac{-(Icc + Ib4 - Ib1) \times R2}{V_T}\right), \quad (3)$$

the output current Ix and the control current Icc have an exponential relationship.

For example, reference current source CS4 can be a proportional to absolute temperature (PTAT) current source, such that the gain of the current generator 100 is independent from temperature.

Figure 4:
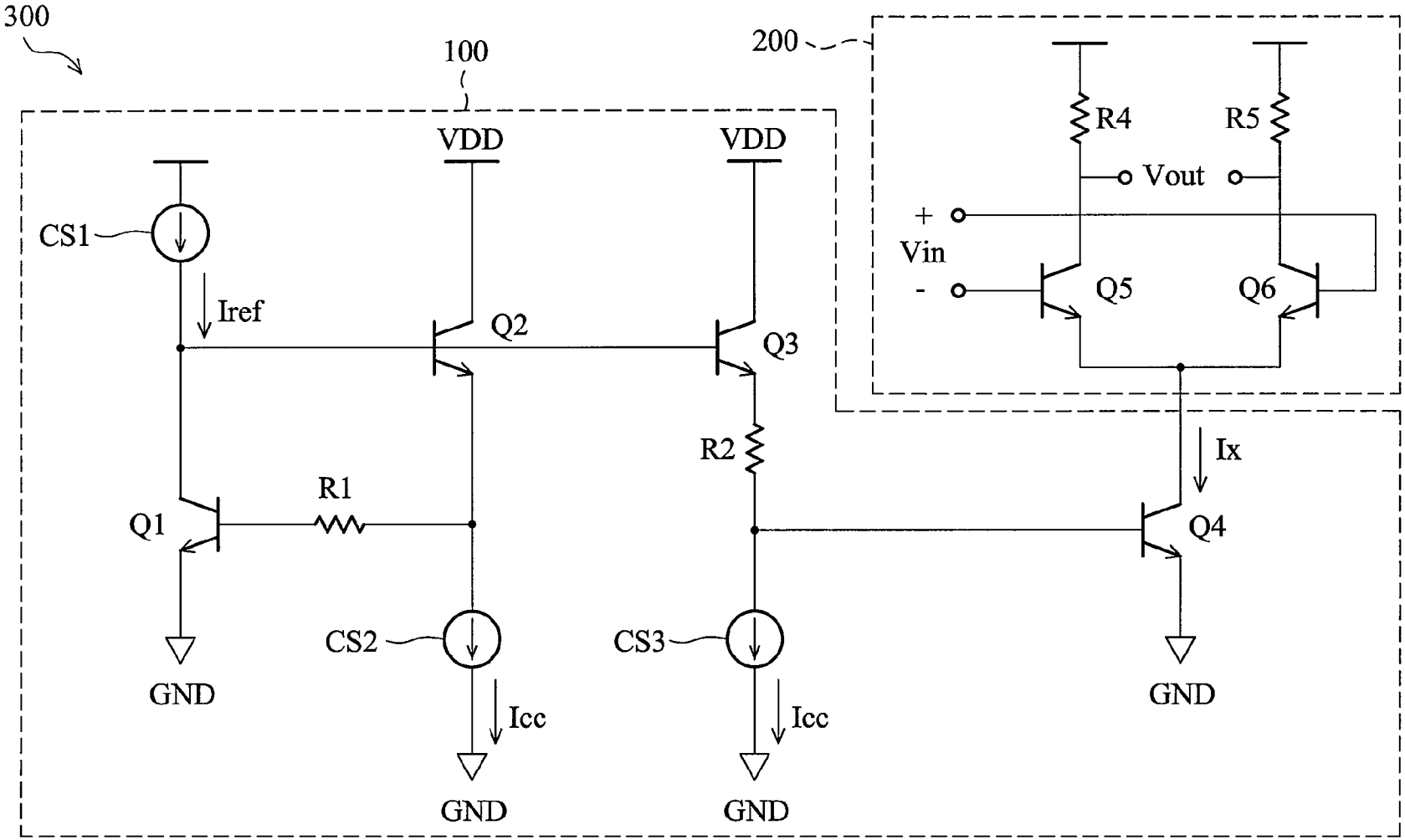
FIG. 4 shows an embodiment of a variable gain amplifier of the invention.

FIG. 4 shows an embodiment of a variable gain amplifier in the invention. As shown, the variable gain amplifier 300 comprises the disclosed linear-in-dB current generator 100 and an amplifier unit 200. The disclosed linear-in-dB current generator 100 provides an output current Ix as a bias current. The amplifier unit 200 comprises transistors Q5 and Q6 and resistors R4 and R5, in which the resistor R4 is identical to the resistor R5 and the transistor Q4 is identical to the transistor Q5. The amplifier unit 200 is biased by the output current Ix from the disclosed linear-in-dB current generator 100, and receives the input signal Vin to generate an output signal Vout, and comprises a gain proportional to the bias current (the output current Ix).

Figure 5:
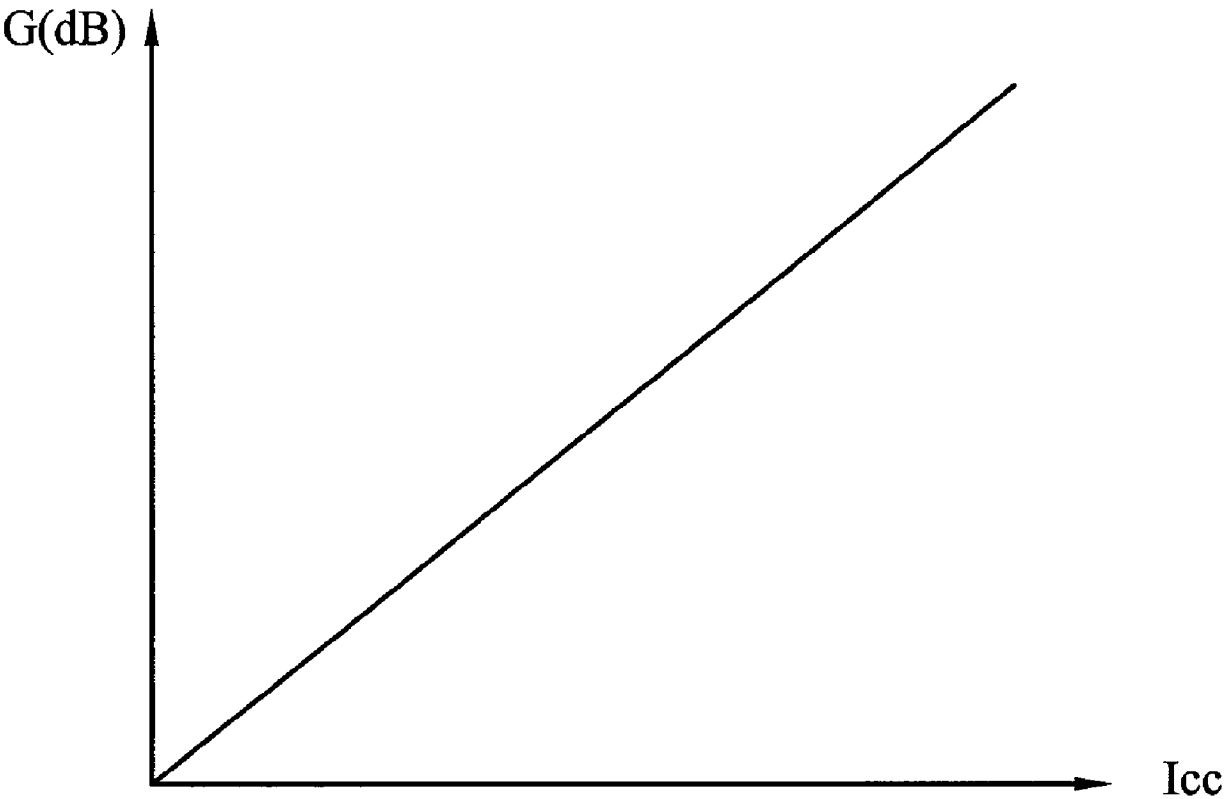
FIG. 5 shows a relationship between the gain of the variable gain amplifier and control current in the invention.

In the embodiment, gain of the variable gain amplifier 300 is proportional to transconductance gm of the transistors Q5 and Q6, and the transconductance gm of the transistors Q5 and Q6 is proportional to the current Ix. As the control current Icc and the current Ix from the linear-in-dB current generator 100 have an exponential relationship, the gain of variable gain amplifier 300 and the control current Icc have an exponential relationship. This relationship between the control current and the resulting gain in the amplifier is referred to herein as "linear-in-dB" since an exponential gain function is linear on a log scale. Namely, the voltage gain G is proportional to the control current Icc, as shown in FIG. 5.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A linear-in-dB current generator, comprising:

a first transistor coupled between a first node and a first power voltage, comprising a control terminal;

a first resistor coupled between the control terminal of the first transistor and a second node;

a second transistor coupled between the second node and a second power voltage, comprising a control terminal coupled to the first node;

a first current source coupled between the second node and the first power voltage;

a third transistor comprising a first terminal coupled to the second power voltage, a control terminal coupled to the first node, and a second terminal;

a second resistor coupled between the second terminal of the third transistor and a third node;

a fourth transistor comprising a first terminal coupled to the first power voltage, a control terminal coupled to the third node, and a second terminal outputting an output current;

a second current source coupled between the first power voltage and the third node; and a reference current source coupled between the second power voltage and the first node.

2. The linear-in-dB current generator as claimed in claim 1, wherein the first resistor is identical to the second resistor.

3. The linear-in-dB current generator as claimed in claim 1, wherein the first, the second, the third and the fourth transistors are BJT transistors.

4. The linear-in-dB current generator as claimed in claim 1, wherein the first and the second current sources comprise:

a current source providing a controllable current; and a current mirror receiving the controllable current to generate at least two currents.

5. The linear-in-dB current generator as claimed in claim 4, wherein the current mirror comprises:

a fifth transistor coupled between the second power voltage and a fourth node, comprising a control terminal coupled to the controllable current source;

a sixth transistor coupled between the first power voltage and the controllable current source, comprising a control terminal coupled to the fourth node;

a seventh transistor comprising a first terminal coupled to the first power voltage, a control terminal coupled to the fourth node, and a second terminal;

a third resistor coupled between the second node and the second terminal of the seventh transistor; and an eighth transistor coupled between the third node and the first power voltage, comprising a control terminal coupled to the fourth node.

6. The linear-in-dB current generator as claimed in claim 5, wherein the first to eighth transistors are BJT transistors.

7. The linear-in-dB current generator as claimed in claim 1, further comprising a current compensation unit providing a compensation current to the first node.

8. The linear-in-dB current generator as claimed in claim 7, wherein the current compensation unit comprises a fifth transistor coupled between the second power voltage and a fifth node, comprising a control terminal;

a sixth transistor coupled between the second power voltage and the first node, comprising a control terminal coupled to the control terminal of the fifth transistor;

a seventh transistor comprising a first terminal coupled to the second power voltage, a control terminal coupled to the fifth node, and a second terminal; and an eighth transistor coupled between the first power voltage and the second terminal of the seventh transistor, comprising a control terminal coupled to the fourth node.

9. The linear-in-dB current generator as claimed in claim 8, wherein the fifth and the sixth transistors are MOS transistors and the seventh and the eighth transistors are BJT transistors.

10. The linear-in-dB current generator as claimed in claim 8, wherein the size of the sixth transistor is N times that of the fifth transistor and N>1.

11. A variable gain amplifier, comprising:

a linear-in-dB current generator as claimed in claim 1, providing the output current as a bias current; and an amplifier unit coupled to the current generator, comprising a gain proportional to the bias current.

12. A linear-in-dB current generator, comprising:

a first transistor coupled between the first node and a first power voltage, comprising a control terminal;

a first resistor coupled between the control terminal of the first transistor and a second node;

a second transistor coupled between the second node and a second power voltage, comprising a control terminal coupled to the first node;

a third transistor comprising a first terminal coupled to the second power voltage, a control terminal coupled to the first node, and a second terminal;

a second resistor coupled between the second terminal of the third transistor and a third node;

a fourth transistor comprising a first terminal coupled to the first power voltage, a control terminal coupled to the third node, and a second terminal outputting an output current;

a first reference current source coupled between the second power voltage and the first node;

a second reference current coupled between the second power voltage and a fourth node;

a fifth transistor coupled between the second power voltage and a fifth node, comprising a control terminal coupled to the fourth node;

a sixth transistor coupled between the first power voltage and the fourth node, comprising a control terminal coupled to the fifth node;

a seventh transistor comprising a first terminal coupled to the first power voltage, a control terminal coupled to the fifth node, and a second terminal;

a third resistor coupled between the second node and the second terminal of the seventh transistor; and an eighth transistor coupled between the third node and the first power voltage, comprising a control terminal coupled to the fifth node.

13. The linear-in-dB current generator as claimed in claim 12, wherein the first, the second and the third resistors are identical.

14. The linear-in-dB current generator as claimed in claim 13, wherein the first, the second, the third and the fourth transistors are BJT transistors.

15. The linear-in-dB current generator as claimed in claim 14, further comprising a current compensation unit providing a compensation current to the first node to compensate base currents of the second and third transistors.

16. The linear-in-dB current generator as claimed in claim 15, wherein the current compensation unit comprises a ninth transistor coupled between the second power voltage and a sixth node, comprising a control terminal;

a tenth transistor coupled between the second power voltage and the first node, comprising a control terminal coupled to the control terminal of the ninth transistor;

a eleventh transistor comprising a first terminal coupled to the second power voltage, a control terminal coupled to the sixth node, and a second terminal; and a twelfth transistor coupled between the first voltage and the second terminal of the eleventh transistor, comprising a control terminal coupled to the fifth node.

17. The linear-in-dB current generator as claimed in claim 16, wherein the fifth and the sixth transistors are MOS transistors and the seventh and the eighth transistors are BJT transistors.

18. The linear-in-dB current generator as claimed in claim 17, wherein the tenth transistor is twice the size of the ninth transistor.

19. A variable gain amplifier, comprising:

a linear-in-dB current generator as claimed in claim 12, providing the output current as a bias current; and an amplifier unit coupled to the current generator, comprising a gain proportional to the bias current.

* * * * *